US007007317B1

(12) United States Patent
Brown

(10) Patent No.: US 7,007,317 B1
(45) Date of Patent: Mar. 7, 2006

(54) SINK/FAUCET FLUSH MOUNTING SYSTEM

(75) Inventor: Richard William Brown, Midland (CA)

(73) Assignee: Niro-Plan AG, Aarburg (CH)

( * ) Notice: Subject to any disclaimer, the term of this patent is extended or adjusted under 35 U.S.C. 154(b) by 0 days.

(21) Appl. No.: 11/117,418

(22) Filed: Apr. 29, 2005

(51) Int. Cl.
*A47K 1/00* (2006.01)
*E03C 1/33* (2006.01)

(52) U.S. Cl. ..... 4/631; 4/632

(58) Field of Classification Search ..... 4/631–635, 4/675; 52/389; 249/13; 312/140.3
See application file for complete search history.

(56) References Cited

U.S. PATENT DOCUMENTS 4,374,695 A 2/1983 Ikeda et al.
5,016,297 A 5/1991 Sauter et al.
5,551,103 A 9/1996 Drozdowich et al.
5,754,991 A 5/1998 Drozdowich et al.
5,860,172 A 1/1999 Pfeiffer
6,108,831 A * 8/2000 Lombreglia, Jr. ..... 4/631
6,349,429 B1 2/2002 Zurba et al.
6,691,341 B1 * 2/2004 Loch ..... 4/632

* cited by examiner

*Primary Examiner*—Tuan Nguyen
(74) *Attorney, Agent, or Firm*—Bereskin & Parr

(57) ABSTRACT

This invention deals with a sink having a flange can be flush mounted in a countertop where the countertop is made of a laminate upper layer supported by a wood based body such as particle board. The countertop is readied for sink mounting by ploughing out a sink channel in the supporting body of the countertop. The sink channel is filled with a hardenable plastic such as an epoxy. The upper surface of the epoxy and the laminate is machined such as by a router to create a rabbet to accommodate the flange of the sink. The sink channel is arranged so that the hardened epoxy extends under the laminate so that any water which passes under the flange of the sink will contact the epoxy and not the wood based structure. A faucet having holes to accommodate hot water, cold water, spigot and faucet accessories can be mounted using the same channel and epoxy system.

20 Claims, 16 Drawing Sheets

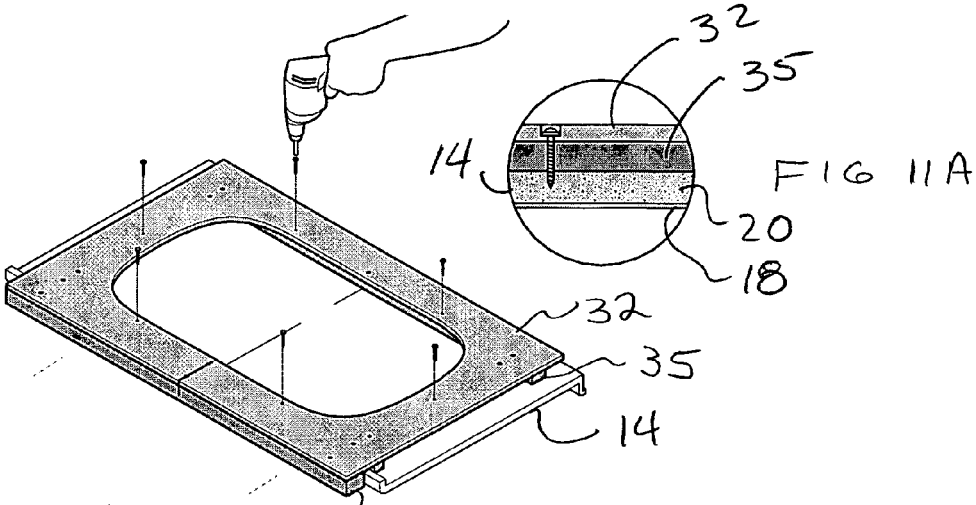
FIG 11A
FIG 11
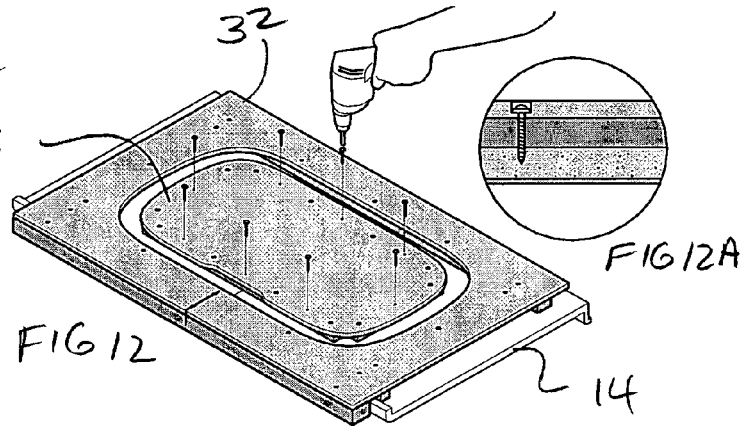
FIG 12A
FIG 12
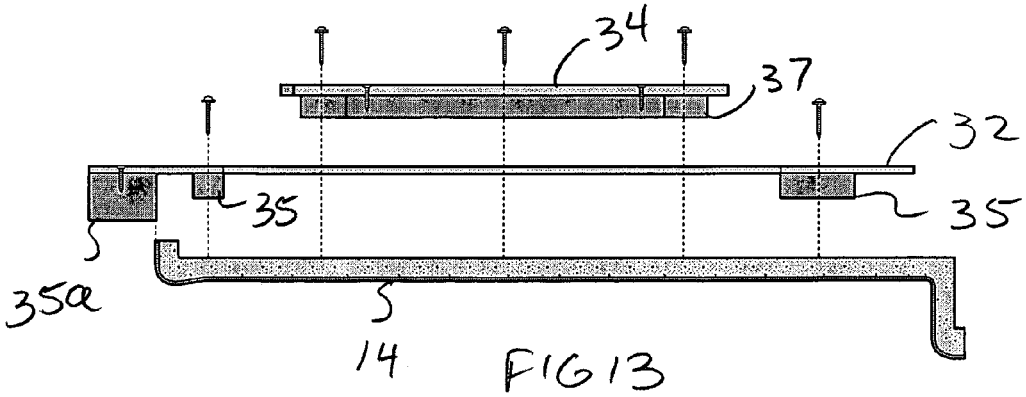
FIG 13

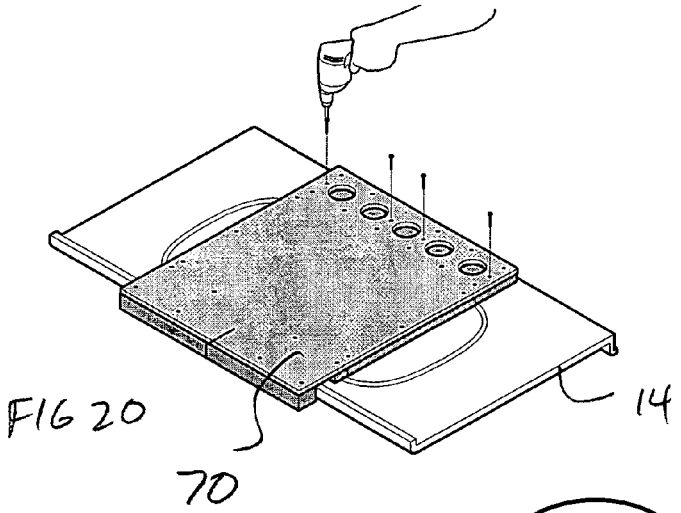
FIG 20
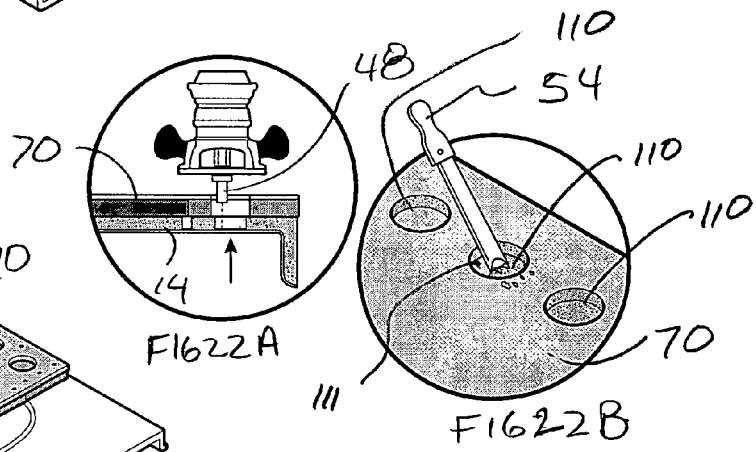
FIG22A
FIG22B
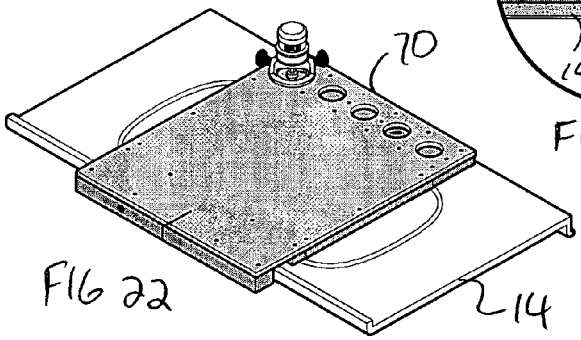
FIG 22
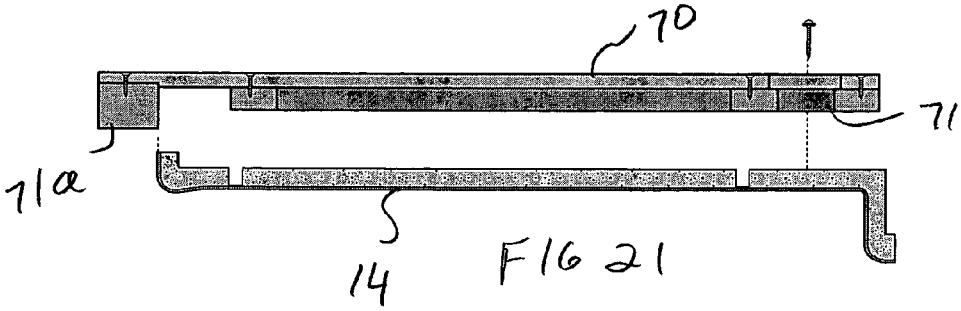
FIG 21

SINK/FAUCET FLUSH MOUNTING SYSTEM

FIELD OF THE INVENTION

This invention relates generally to the installation of plumbing appliances, particularly sinks and faucets in a countertop. In particular, the invention relates to a method of flush mounting a sink in a countertop.

BACKGROUND OF THE INVENTION

Counters may be manufactured from various sources both natural and manmade. While recently as a decorating item, there has been a strong emphasis on use of natural materials such as granite and marble there has also been a use of solid manmade products which simulate granite or marble. Typical of these is the surfacing material sold under the trade mark CORIAN™. While all of these materials are durable, they are generally expensive to supply and install.

A counter having excellent value characteristics which has been available for a long time and has been used in many domestic, industrial, commercial and other installations is a countertop which has an upper laminate layer which provides the appearance and durability layer. The laminate layer is mounted on some type of supporting structure. The supporting structure is typically a wood based material such as particle board. This type of countertop may be formed with a back splash, a bull nose front edge or other configurations that are desirable. When mounting a typical sink, the position of the sink is first determined and then a cutout is made which is sufficiently large to accommodate the bowl of the sink while the flange of the sink rests on the laminate layer of the countertop. In order to inhibit passage of water between the laminate layer and the flange of the sink, the sink is usually mounted in some type of sealant or bedding compound.

While the foregoing mounting system has been utilized as a standard, there has always been the desire to have a mounting system in which the flange of the sink is mounted so that it is flush with the upper surface of the top of the countertop. In the case of a granite, marble or other manmade type of counter, a rabbet can be formed in the countertop material and the sink mounted with the flange in a flush condition. However, if that type of mounting is utilized with the typical countertop having a laminate upper surface, once the laminate is removed, then the underlying wood based support structure, particularly particle board, is no longer protected by the laminate layer. In most cases, there will be an unacceptably early failure of the countertop if water is permitted to enter into the wood based substrate. Accordingly, flushmount installations are not used in connection with the type of countertop which provides the excellent value referred to above.

It is an object of the present invention to provide a method for flush mounting a plumbing appliance such as a sink having a flange or a faucet in a countertop comprised of an upper laminate layer and a underlying wood based support body.

SUMMARY OF THE INVENTION

In accordance with the invention, a method of mounting a plumbing appliance such as a sink in a countertop having an upper laminate surface layer and an underlying wood based support layer involves providing a sink, the sink having a peripheral mounting flange, forming a channel in the support body, adding a hardenable plastic to the channel, permitting the plastic in the channel to harden, cutting the hardened plastic and the laminate surface to form a sink opening adapted to receiving the flange of the sink and mounting the sink in the sink opening with the upper surface of the flange flush with the upper surface of the laminate.

In accordance with another aspect of the invention a method of mounting a faucet in such a countertop involves forming a plurality of channels in the support body, adding a hardenable plastic to the channels, permitting the plastic in the channels to harden, cutting the hardened plastic and the laminate surface to form a plurality of faucet openings adapted to receive the faucet.

BRIEF DESCRIPTION OF THE DRAWINGS

A better understanding of the invention will be apparent from reference to the attached drawings which illustrate, by way of example, embodiments of methods of mounting a sink and a faucet in a countertop in accordance with the invention and wherein:

FIGS. 4 through 17 indicate steps in accordance with the method of the installation of FIG. 1 relating to a first aspect of the invention;

FIGS. 18 through 22B illustrate steps in accordance with the method of installation of FIG. 1 relating to a second aspect of the invention;

DETAILED DESCRIPTION OF THE INVENTION

Figure 1:
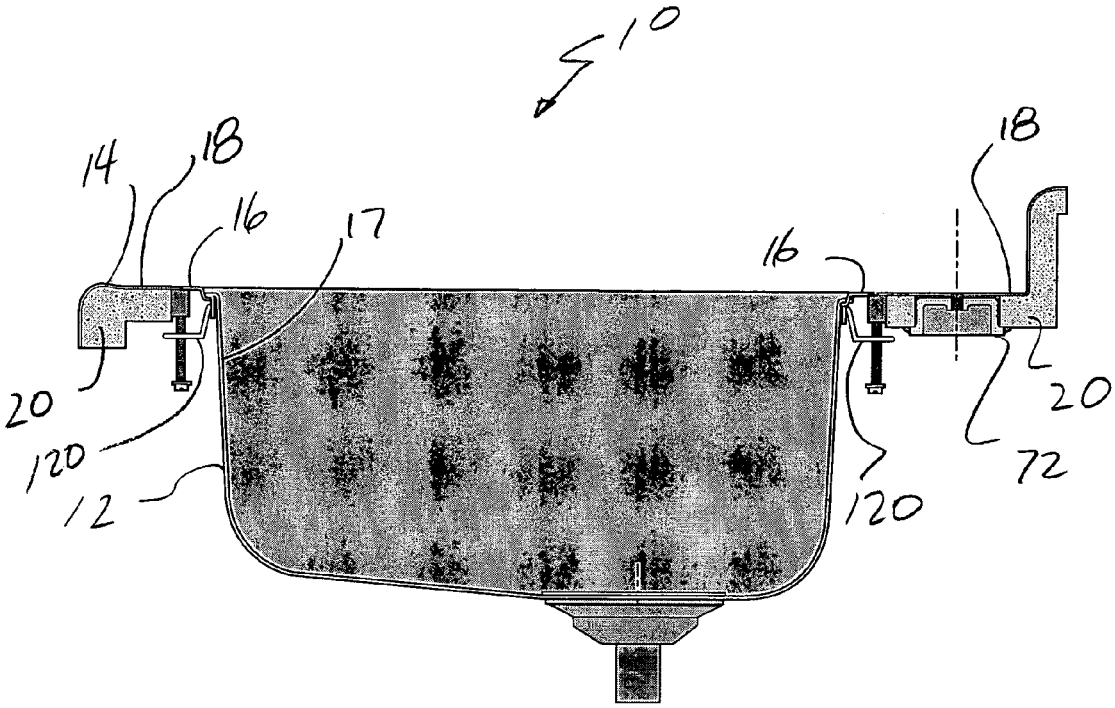
FIG. 1 is a side view of the completed installation of a sink in accordance with this embodiment of the invention.

FIG. 1 illustrates the completed installation in accordance with the first and second aspects of the invention generally at 10. The method described in the description may be used to install plumbing fixtures namely sinks and faucets and related accessories. FIG. 1 illustrates a sink 12 having been installed in a countertop 14. The sink 12 has a peripheral mounting flange 16 which surrounds the bowl 17 of the sink. The countertop 14 has an upper laminate surface layer 18 and an underlying wood based support body 20. Typically, the underlying support body 20 may be manufactured from a wood based product such as a particle board substrate. The method in accordance with the present invention is, however, not limited to utilization with particle board substrates. Generally, any type of countertop in which there is an upper laminate surface and a supporting body which may be expected to deteriorate if there is water access, provide good candidates for use of the invention.

Figure 3:
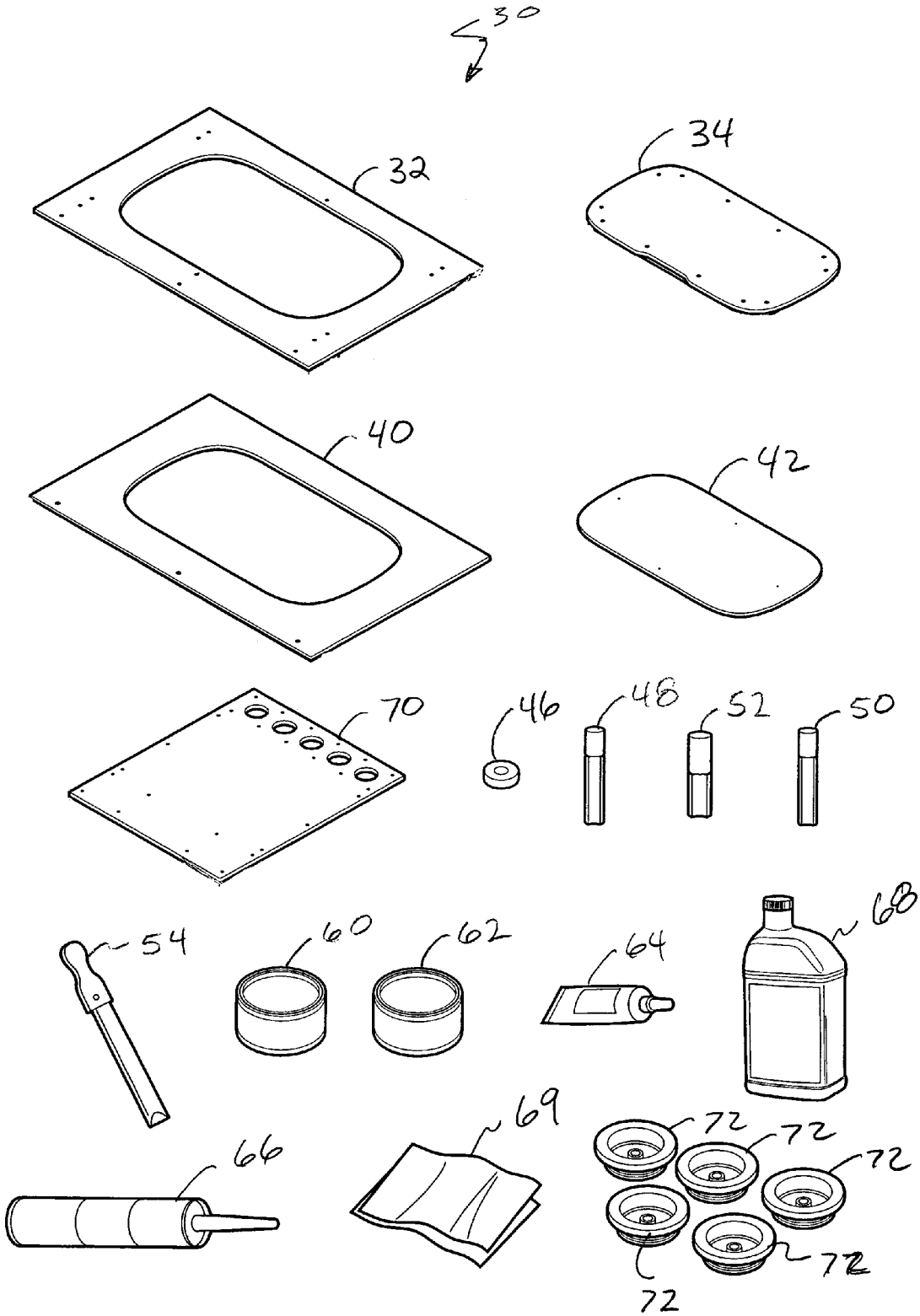
FIG. 3 is a schematic presentation of a kit of parts that is useful in carrying out the methods in accordance with the embodiments of the invention shown in FIG. 1.

FIG. 3 illustrates a kit of parts. The kit illustrated generally at 30 facilitates the carrying out of the method as described hereinafter. The kit includes a first sink template 32 and a first sink core 34. The kit also includes a second sink template 40 and a second sink core 42. Advantageously, the kit 30 includes a guide bushing 46, a first cutter 48, a second cutter 50 and a proprietary cutter 52. Advantageously, the kit includes a chisel 54. In addition, the kit advantageously contains resin 60, hardener 62 and a pigment 64. In addition, the kit advantageously contains a sealant 66, a bottle of methyl hydrate 68 and wipers 69.

The foregoing components of the kit 30 are advantageously used to carry out the installation of a sink in accordance with a first aspect of the invention.

Advantageously, the kit 30 may include additional components to carry out a second aspect of the invention. These include a faucet template 70 and a plurality of faucet hole plugs 72.

In accordance with the first aspect of the invention, the sink 12 may be mounted in a countertop 14 as will be explained in greater detail below. In accordance with a second aspect of the invention, a faucet may be mounted on the same countertop 14. It is not necessary that the faucet be mounted utilizing the second aspect of the invention, though the sink may have been mounted in accordance with the first aspect of the invention. However, advantageously, as will be more fully explained below, there are significant advantages of utilizing the second aspect of the invention to mount a faucet to the countertop 14.

Generally speaking, the method in accordance with the invention involves the steps of determining the sink layout, making up a first sink template, machining a sink channel in the support body of the countertop, filling the sink channel with a hardenable plastic and allowing the plastic to harden, preparing a second sink template, using the second sink template to form a rabbet in the upper surface of the hardened plastic, cutting the opening for the sink bowl, machining the edge of the hardened plastic, and installing the sink. In accordance with the second aspect of the invention, generally speaking, a faucet template is made up, and positioned on the countertop. One or more faucet channels are then cut into the support body of the countertop. Some hardenable plastic is poured into the faucet channels and then a faucet hole plug is inserted into each faucet channel. After hardening of the plastic, the faucet plug is utilized to guide a drill to drill a pilot hole in the laminate layer of the countertop, and that pilot hole is then used to cut a faucet hole. One or more faucet holes as required may be created in this manner and thereafter a faucet is installed to the countertop.

Figure 4A:
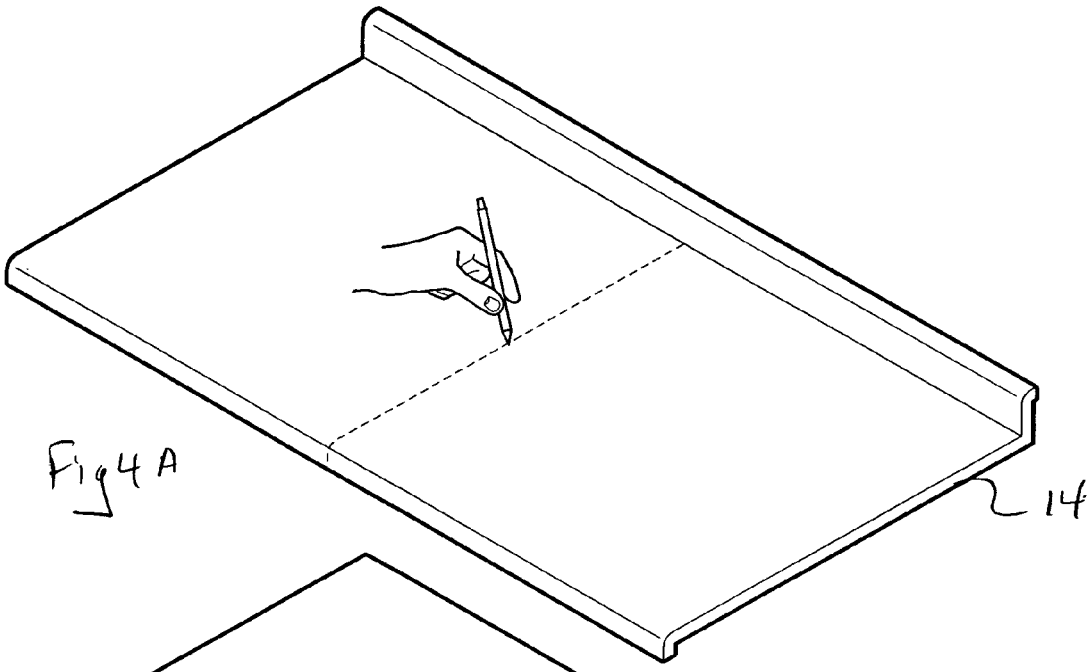
Figure 4B:
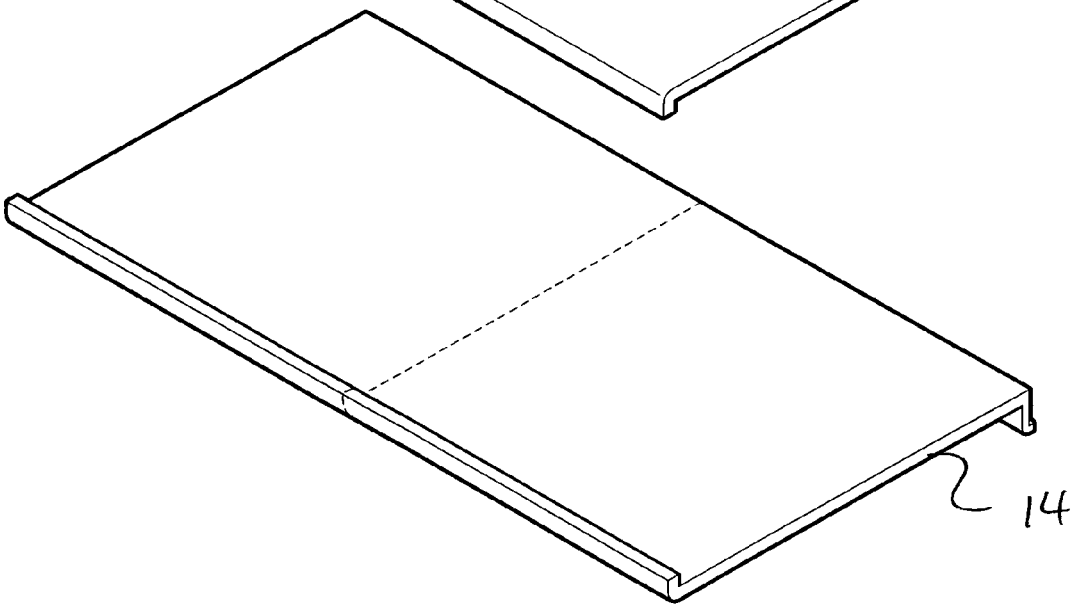

FIG. 4 diagrammatically illustrates the layout for the installation of the sink. Generally speaking, the centre line for the sink is laid out on the countertop. Advantageously, that layout line is carried forward around the usual bull nose front edge of the countertop and then carried around underneath and laid out on the underside of the support body of the countertop.

Figure 5:
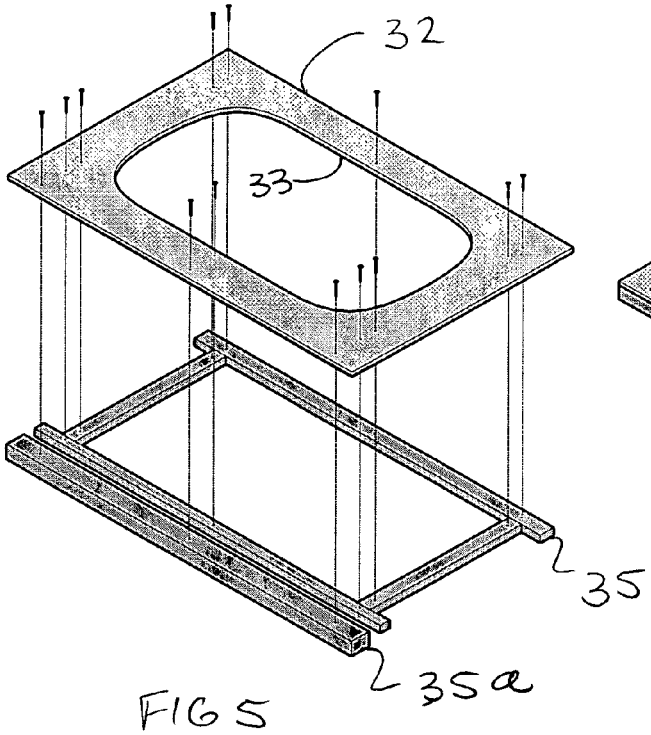
Figure 6:
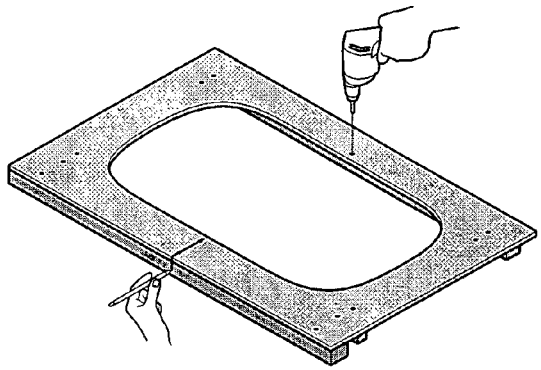

The kit 3 includes a first sink template 32 illustrated in FIG. 5. The first sink template 32 includes an inner peripheral edge 33 which will be used as a guide for a cutting tool. It is expected that most persons installing the sink in accordance with this method will have available to them bridging and fence material. Thus, as shown in FIG. 5, the template 32 is secured to bridging material 35 as well as to a fence material 35*a*. The installation of the fence and bridging material together with the template 32 is illustrated in FIG. 5. Screws may be used to attach the first sink template 32 to the bridging material 35. Those screws should not extend through the fence or bridging material 35. Once assembled, it is helpful to scribe a centre line on the template and fence as shown in FIG. 6.

Figure 7:
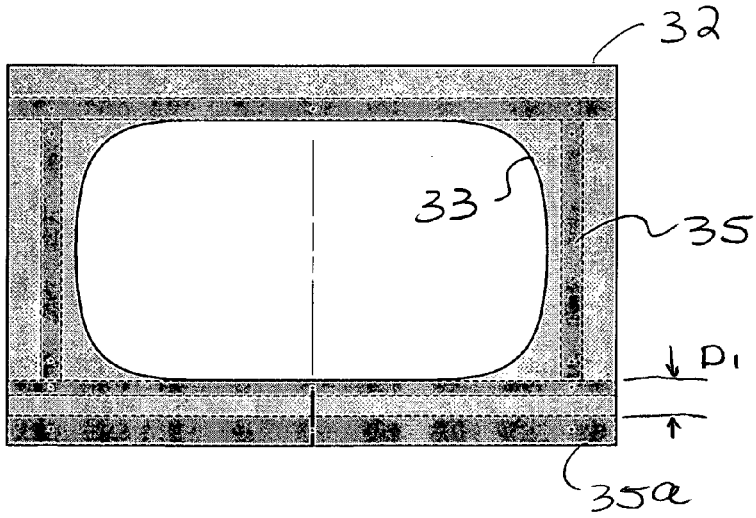

FIG. 7 illustrates a top phantom view of the assembled first sink template 32 together with the fence and bridging 35. This view shows that the bridging material is located outside the periphery 33 of the first sink template 32. In addition, the fence 35*a* is installed a set distance $D_1$ from the front edge of the periphery 33 so as to position the periphery 33 at a predetermined distance from the front edge of the countertop. The critical dimension is shown at $D_1$ in FIG. 7.

Figure 8:
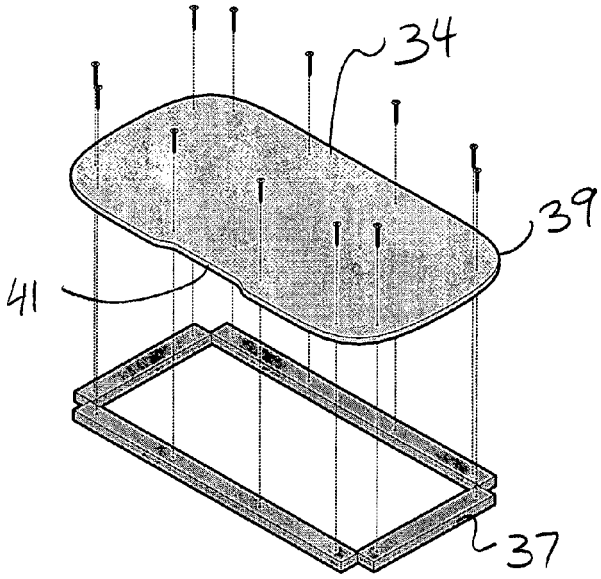
Figure 9:
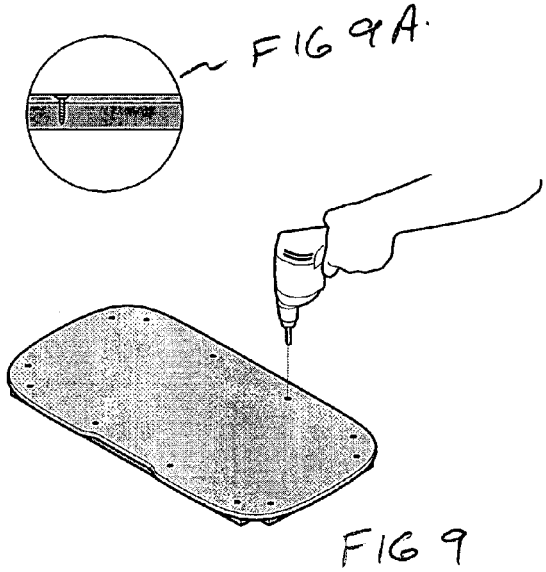
Figure 10:
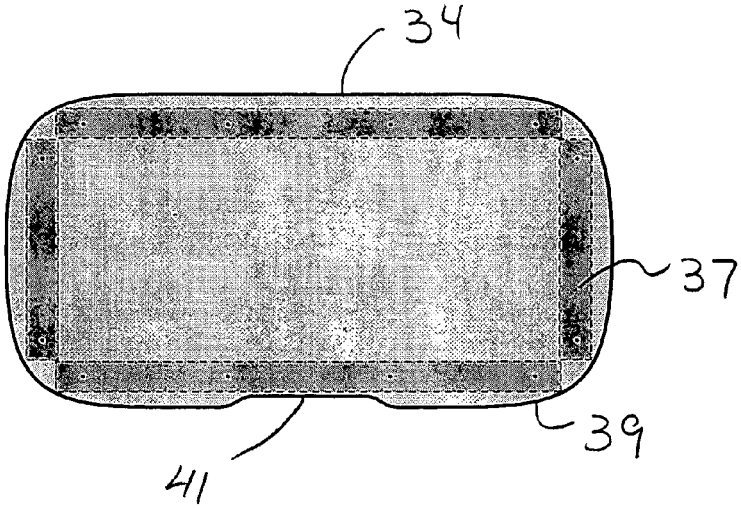
Figure 14:
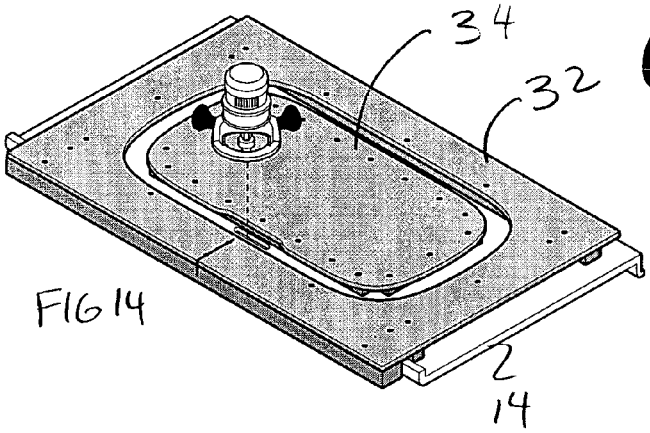

The second step in the process is to assemble the first sink core 34 to similar bridging material 37. The first sink core 34 has an outer periphery 39. The outer periphery 39 includes a router adjustment step 41 which is illustrated in FIGS. 8, 9 and 10. FIG. 10 is a view similar to FIG. 7. FIG. 10 illustrates the assembled first sink core 34 in phantom view showing the assembly of the first sink core 34 together with the bridging material 37. The bridging material 37 is formed within the peripheral edge 39 of the first sink core 34.

The next step in the process, is to attach the first sink template 32 to the underside of the countertop 14. This is shown in FIGS. 11 and 11A. The scribe line on the first sink template 32 establishing the centre of the sink bowl area is lined up with the scribe line put on the underside of the counter as described previously. The first sink template 32 is attached to the counter by screws which project through the bridge material and into the support body of the countertop 14. The screws are not long enough, however, to contact or pierce the laminate surface layer as shown in FIG. 11A.

The next step in the process is to attach the first sink core 34 to the underside of the countertop. This is shown in FIGS. 12 and 12A. Again, the screws are sufficiently long to pass through any bridging material and into the support body but not long enough to contact the laminate layer. This is shown in FIG. 12A. For greater clarification, FIG. 13 is an exploded view illustrating the installation of the first sink template 32 and the first sink core 34 to the underside of the counter 14.

Figures 37, 37A, 38, 38A, 39, 40:
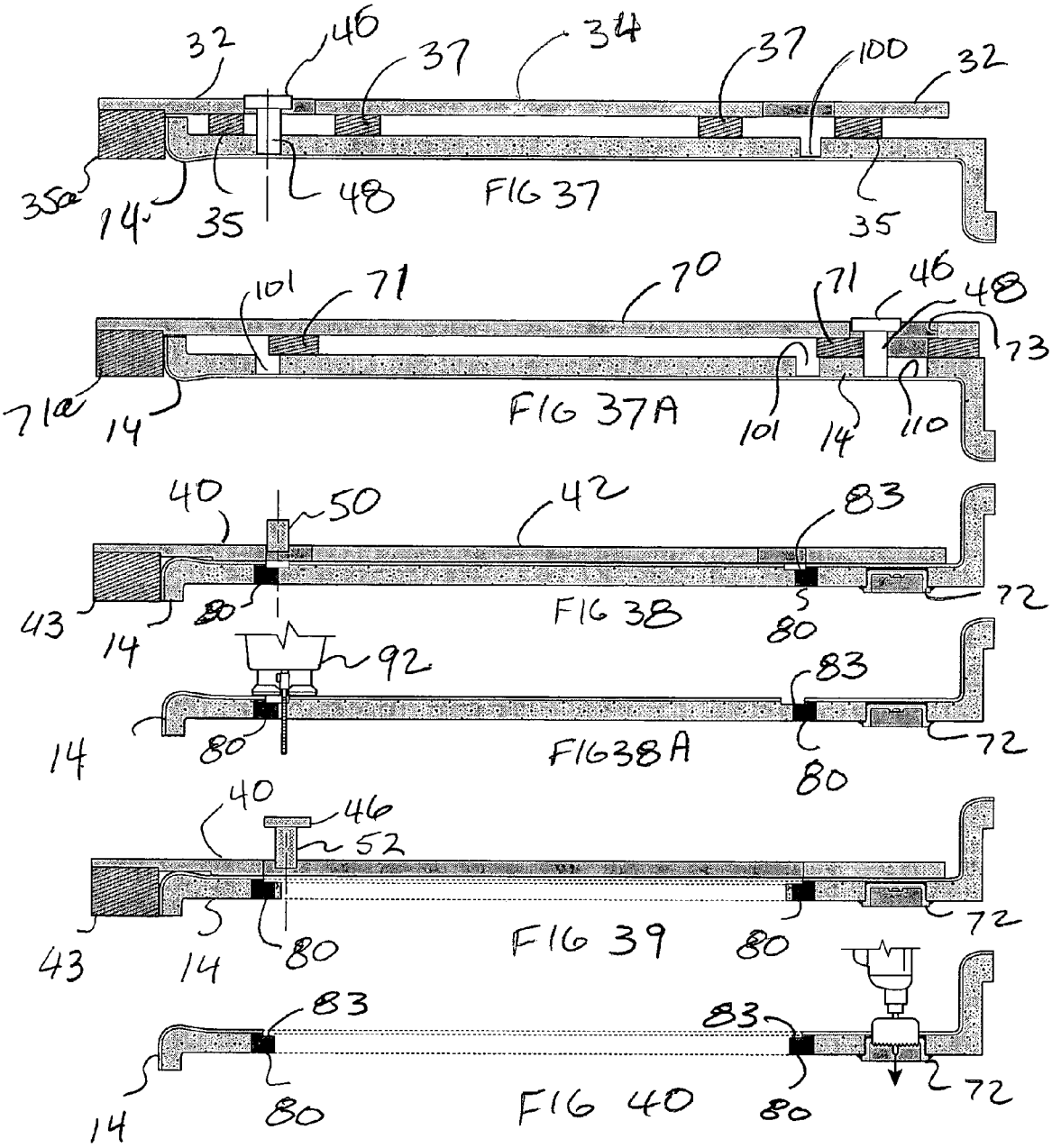
FIGS. 37 through 40 illustrate some of the components illustrated in FIG. 3.

The next step in the process is to create a sink channel. This is illustrated diagrammatically in FIGS. 14 through 17. Advantageously, a router is used to create the channel. For guiding the router along the inner periphery 33 of the first sink template 32, the router is fitted with a guide bushing 46 (FIG. 3) which will ride against the template 21. The router is also fitted with a cutter 48 (FIG. 3) which is adapted to make a plunge cut within the support body 20 of the countertop 14. The location of the bushing and cutter is illustrated in FIG. 37.

Figure 15:
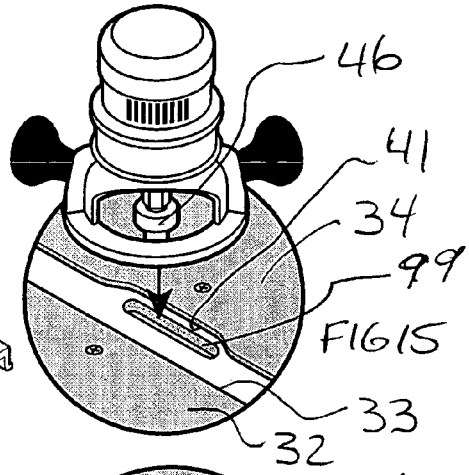
Figure 16A:
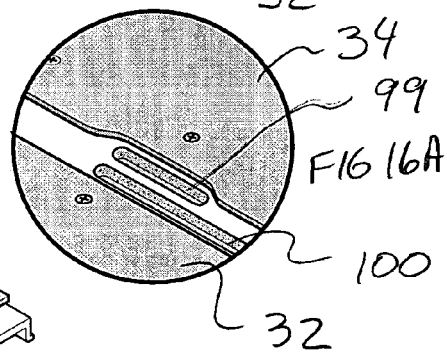
Figure 16:
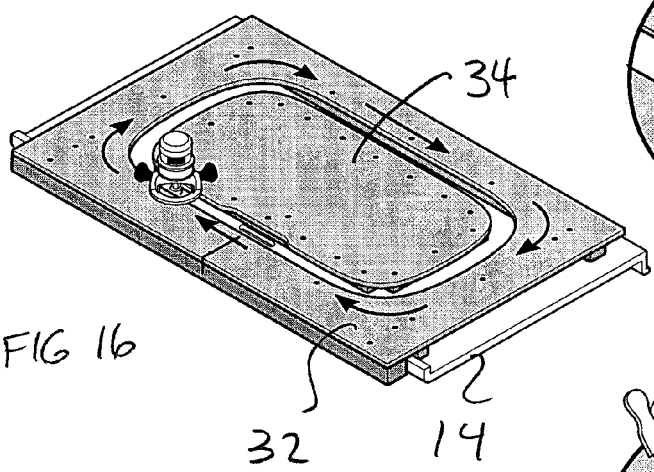
Figure 17:
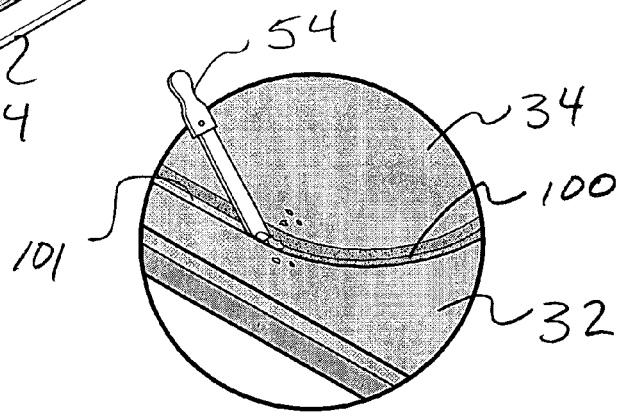

When making the sink channel, the objective is to remove the support body 20 but not to touch or damage the underneath side of the laminate surface layer 18. Accordingly, the router must be tested to set a depth which is satisfactory. It is suggested that, preferably, the router cut away the support body 20 of the countertop 14 so that approximately 1/32 of an inch of the material of the support body 20 would remain adjacent to the laminate layer 18. In order to provide for test cuts of the router adjusting process, the router can be plunge cut in the area of the router adjustment step 41 illustrated in FIG. 8. The test channel cutting within the area 41 is illustrated in FIG. 15 at 99. Once the router depth has been adjusted as desired, then the guide bushing 46 is placed against the periphery 33 of the first sink template 32 and the periphery 33 is followed by the router to create a sink channel 100, illustrated in FIG. 16A. Once the initial router cut of the sink channel 100 has been completed, the first sink template 32 and the first sink core 34 are removed from the countertop 14. At this time, the chisel 54 from the kit 30 (FIG. 3) is then used to manually remove the remaining 1/32 of an inch of support body material adjacent to the laminate layer 18. This leaves a finished sink channel 101 (FIG. 17) which is surrounded by the lower surface of the laminate layer 18 at the bottom of the finished sink channel 101 and either side of the channel 101 is defined in the support body material 20.

Figure 18:
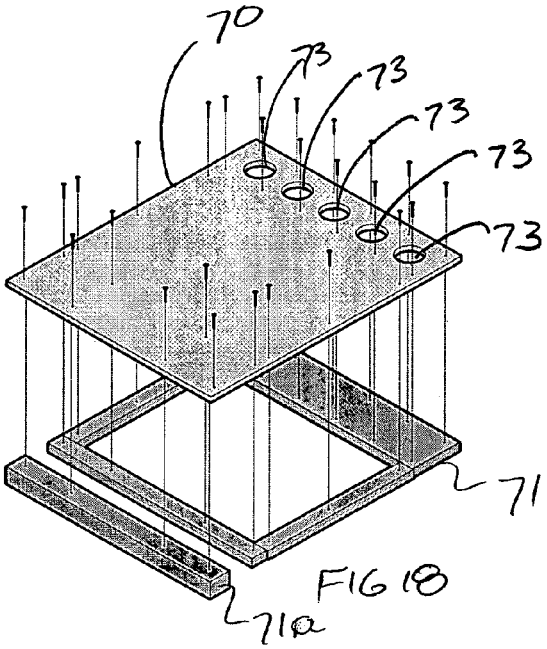
Figure 18A:
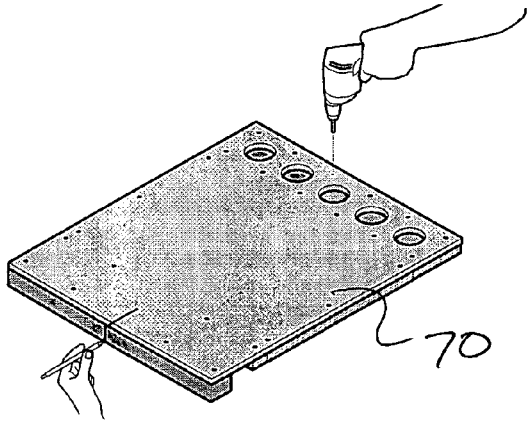
Figure 19:
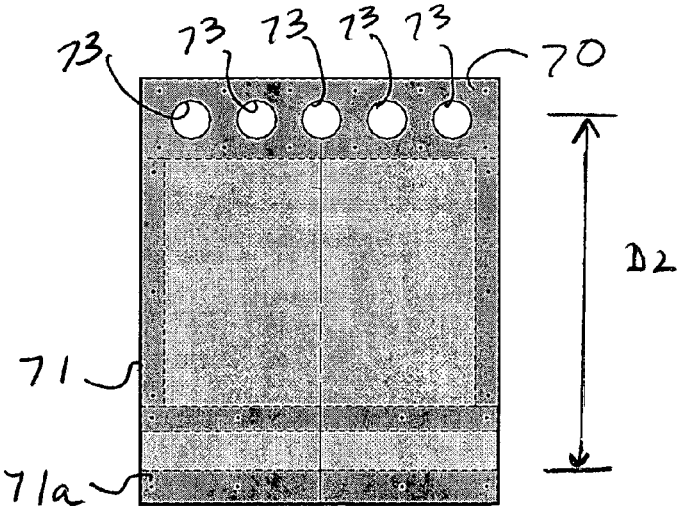

As in most cases, it will be preferable to adopt both the first and second aspect of the invention, the next steps involve the second aspect of the invention. As shown in FIG. 18, the faucet template 70 is attached to a fence and bridging material 71 by screws. The faucet template 70 includes a plurality of faucet channel guides 73 as shown in FIG. 18. Advantageously, the faucet template 70 includes five such faucet channel guides 73. This will then facilitate installation of faucets having various spacings between hot and cold and spigot or other alternative equipment such as soap dispensers, hot water dispensers and the like. FIG. 19, is a phantom view showing the installation of the bridging 71 and fence 71*a* on the faucet template 70. The fence 71*a* is installed a critical distance $D_2$ from the faucet channel guides 73 so that when the faucet template 70 is positioned against the countertop 14, the faucet holes will be aligned as desired.

Following installation of the faucet template 70, as shown in FIGS. 20, 21 and 22, then a router with a plunge bit 48 is used in conjunction with the faucet channel guides 73 to remove the support body 20 to a depth approximately 1/32 of an inch just short of the underneath surface of the laminate layer 18 creating one or more faucet channels 110. This is shown in FIG. 22A. Thereafter, the chisel 54 is used to remove the remaining support body material 20 to form one or more finished faucet channels 111 each of which is bounded at the bottom by the laminate layer 20 and at its circular peripheral wall by the support body material 20 as shown in FIG. 22B.

Figure 23:
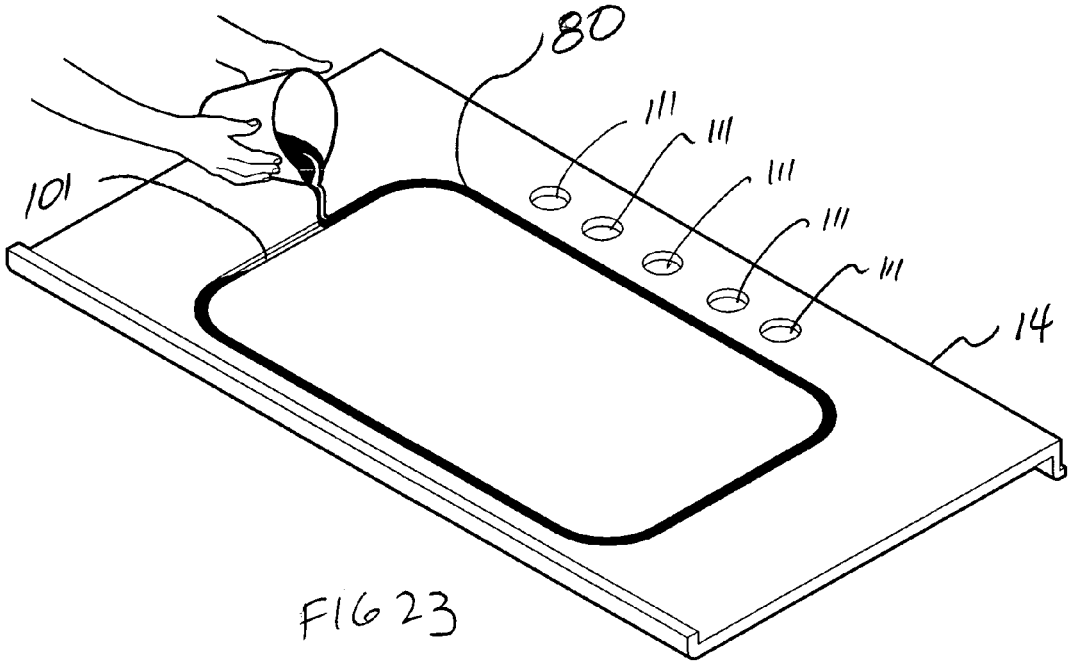
FIG. 23 illustrates a further step in accordance with the first aspect of the invention.

The next step in the method is to cast a sink ring 80. This is shown diagrammatically in FIG. 23. The material used to create the sink ring 80 is advantageously, a two part epoxy. A particularly useful system is that identified under the trade mark WEST SYSTEM 105 RESIN™ and WEST SYSTEM 206 HARDENER™. It is also preferable to use a grey pigment 64 available from West under their designation 503™. The components of the two part epoxy system are mixed in the usual fashion to form a pourable liquid 81. The pourable liquid is poured into the finished sink channel 101 and allowed to harden. Advantageously, and in accordance with the second aspect, the portable liquid is also poured into the finished faucet channels 111 as shown in FIG. 24.

In the case of the sink channel 101, the mixed epoxy is poured into the sink channel 101 until it virtually fills the sink channel 101 and then is allowed to harden.

Figure 24:
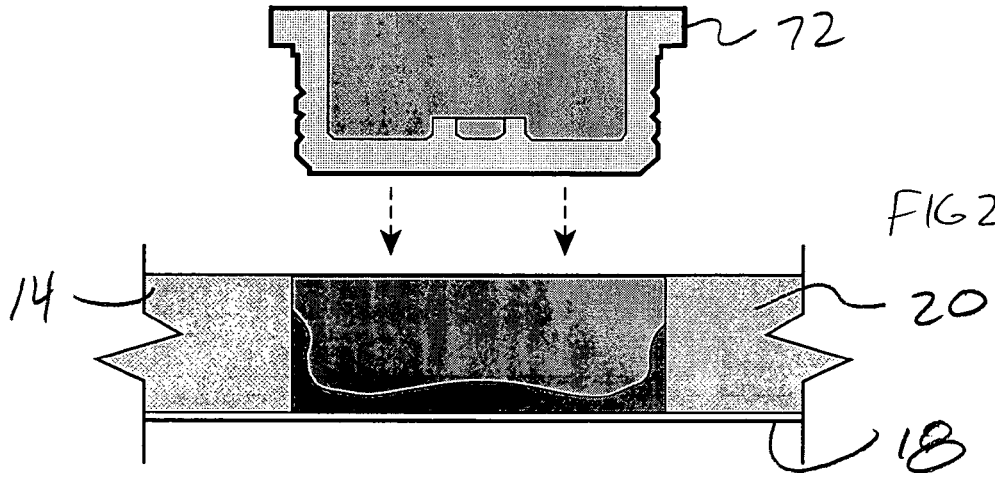
FIGS. 24 and 25 illustrate further steps in accordance with the second aspect of the invention.
Figure 25:
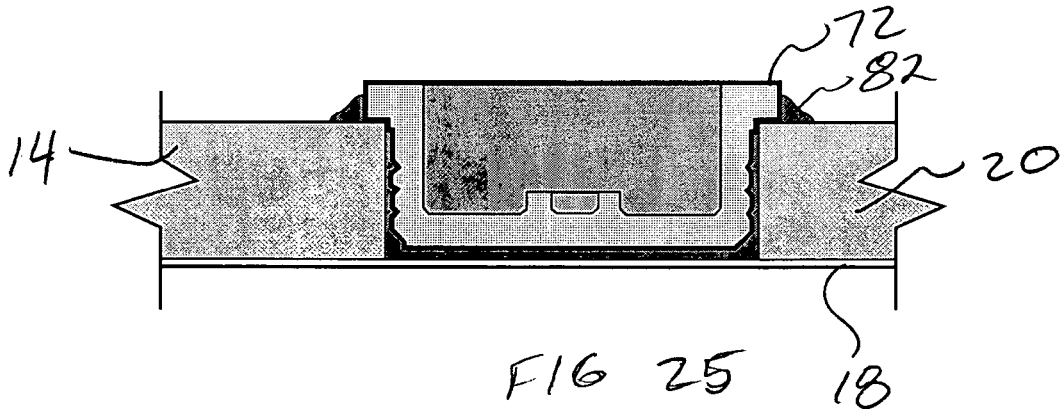

A particularly advantageous aspect of the second aspect of the invention, involves utilization of faucet hole plugs 72 as shown in FIGS. 24 and 25. As shown in FIG. 24, a certain amount of the flowable mixed epoxy material 81 is poured into the finished faucet channel 111. While the epoxy is still flowable, a faucet hole plug 72 is pushed into a faucet channel 111. This displaces the flowable epoxy so that it is forced to flow away from the laminate layer 18 around the periphery of the faucet hole plug 72 and spilling out on the underside of the support body at 82 as shown at FIG. 25.

The epoxy material 81 is then allowed to dry in the sink channel 101 and in each of the faucet channels 111.

Figure 26:
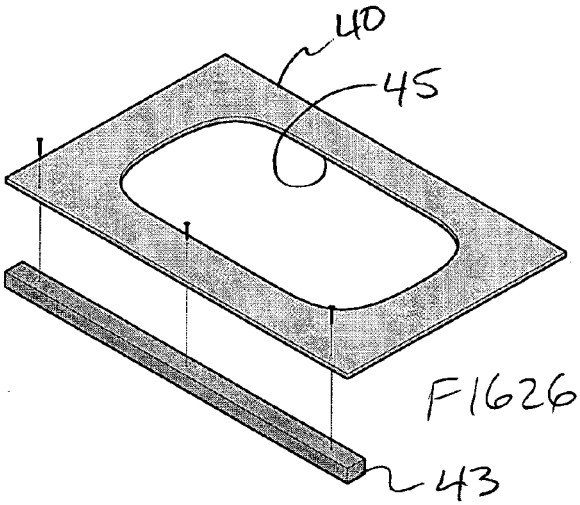
FIGS. 26 through 32 illustrate additional steps in accordance with the first aspect of the invention.
Figure 26A:
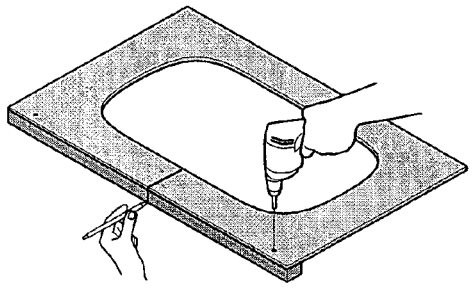
Figure 27:
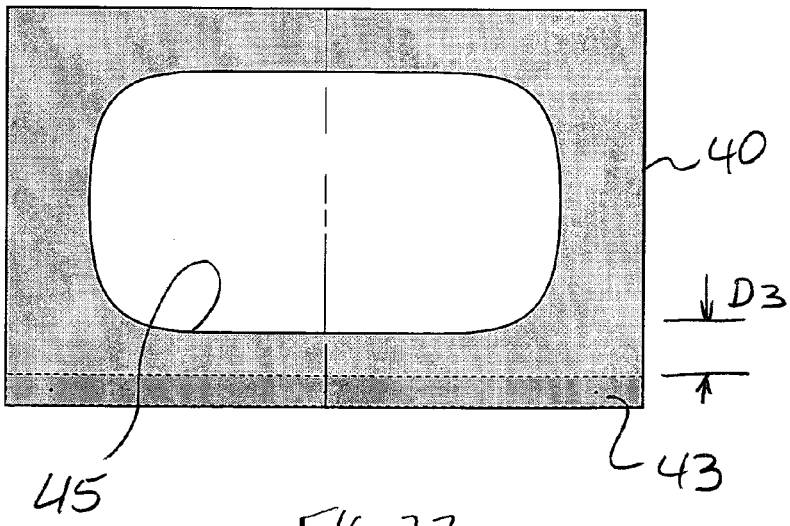
Figure 28:
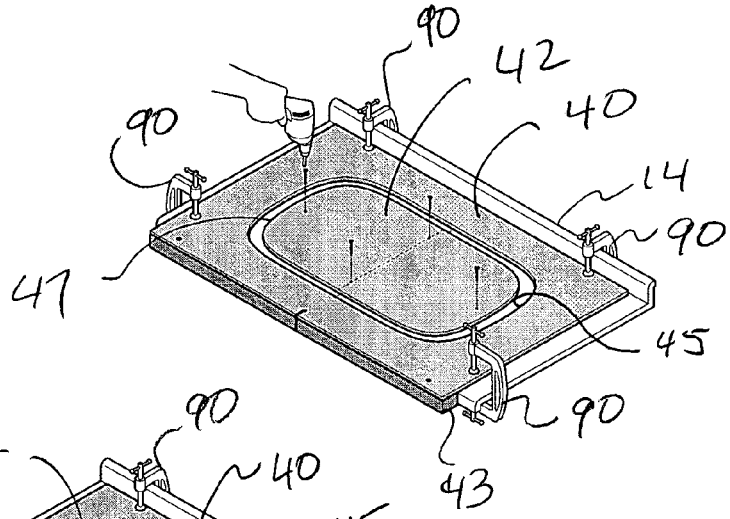
Figure 29:
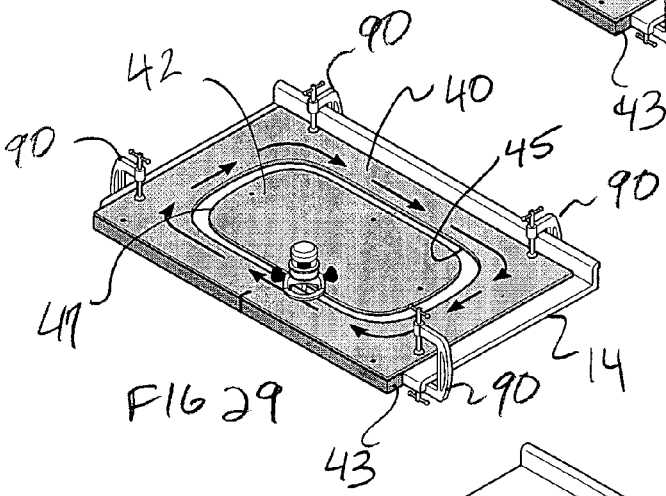

The next step in the first aspect of the invention is to create a rabbet 83 suitable for supporting the flange 16 of the sink 12. This is shown diagrammatically in FIG. 29. In order to form the rabbet 83, the second sink template 40 is assembled as shown in FIGS. 26 and 27. The second sink template 40 is attached to a fence 43. No bridging is required as the template will rest on the laminate 18 when in use. The second sink template 40 comprises an internal periphery 45. The fence 43 is attached to the second sink template 40 a fixed distance D3 from the front edge of the periphery 45. This is shown in a phantom view in FIG. 27. The second sink core 42 has a periphery 47. The second sink template 40 is positioned on the upper surface of the countertop 14 namely against the laminate layer 14. For this reason, the second sink template 40 is held in position by clamps 90 rather than screws. The second sink core 42 is positioned as shown in FIGS. 28 and 29. The second sink core 42 may be screwed to the countertop 14 as the screw holes will be in a scrap portion of the countertop when the opening for the sink is finally cut.

Using a router, and the appropriate collar, the router is guided around the periphery 45. The router cuts a rabbet 83 in the upper surface of the now hardened sink ring 80 and removes the laminate layer 18 from the sink ring 80. In addition, the cutter removes laminate and an equal depth of support body 20. A larger scale illustration of this machining operation is shown in FIG. 38. This operation advantageously uses a custom cutter 52 (see FIG. 3). This cutter is used to create the shallow rebate that will accept the sink rim thickness. This is a cutter with an integral guide bushing that is close in proximity to the cutting surface. In this manner one may use a ½" thick template 40 rather than a template that might be much thicker for a standard cutter and guide bushing. The benefit of this customer cutter is that a lighter template 40 is possible, the cut is more accurate because the cutting surface and bushing are close together, and a thinner template 40 is a more flexible template that will follow the contour of the top surface of the countertop. The depth of the rabbet 83 is selected so that upon installation the upper surface of the flange 16, including sealant referred to subsequently, is flush with the upper surface of the remaining laminate.

The cutter is positioned (see FIG. 38) so that the laminate remains in position over a portion of the hardened plastic to a horizontal distance sufficient to inhibit any water access to the support body. Typically, there is a laminate hardened plastic portion of about ¼" or greater next to the rabbet 83.

Figure 30:
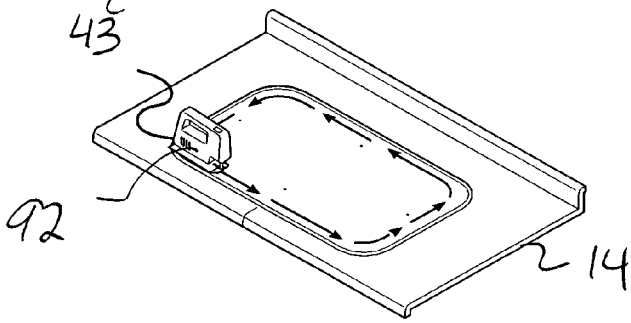
Figure 31:
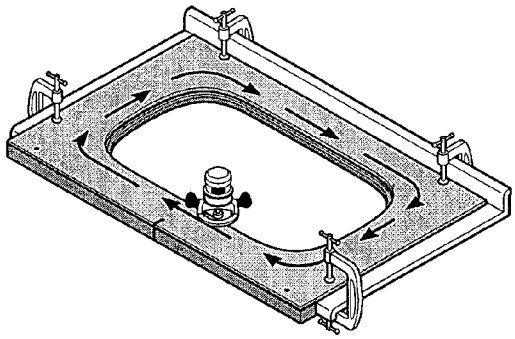
Figure 32:
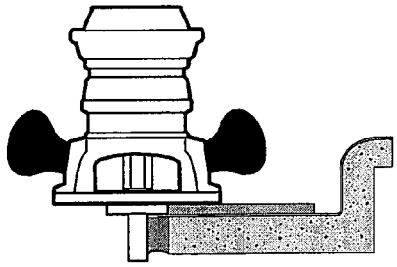

The next step in this aspect of the invention, is illustrated in FIG. 30. The second core 42 is removed from the surface of the countertop 14. Then a jig saw 92 can be used to cut the supporting body material of the countertop 14 which is now visible through the rabbet 83. Ideally the jig saw 92 is used to cut the wood based supporting material of the countertop 14 and is not intended to cut the hardened epoxy. A scrap piece of countertop 14 having an outside dimension substantially related to the desired sink opening in the countertop 14 is then deleted as scrap or left over material. In order to clean up the edge of the epoxy, a separate cutter 50 is used with a bushing as shown in FIGS. 31 and 39 to remove any remaining material from the countertop 14 supporting body material 20. This leaves a clean edge of cast epoxy forming the sink ring 80 around an opening which is now large enough to accommodate the bowl 17 of the sink 12.

Figure 35:
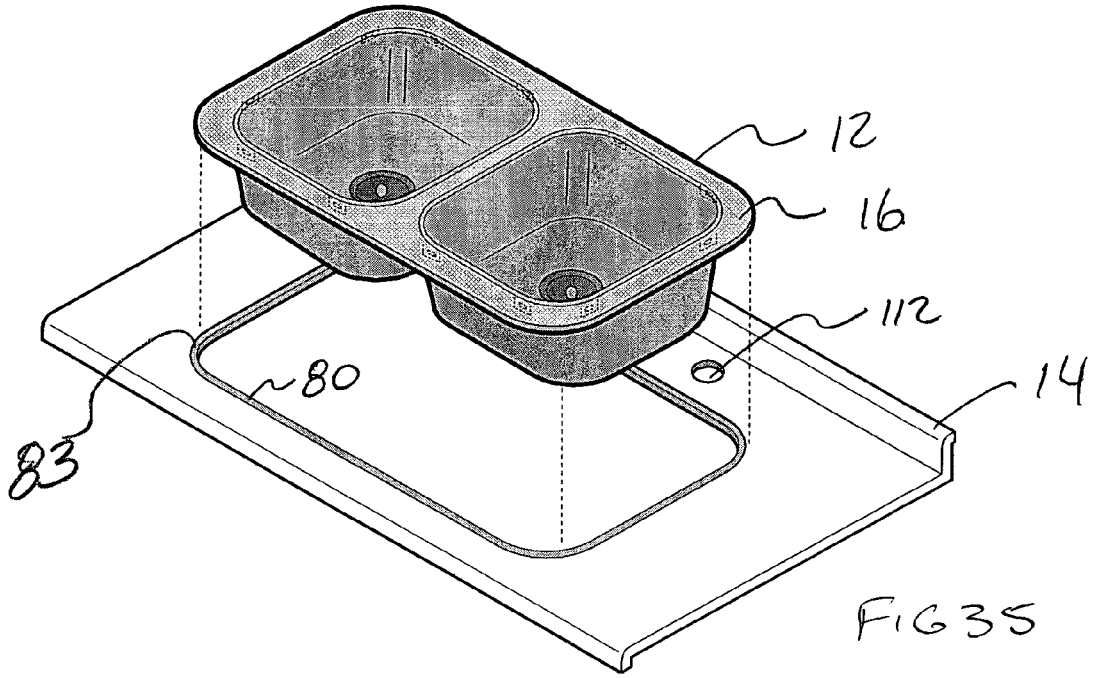
FIGS. 35 and 36 illustrate the installation of a sink in accordance with the steps referred to above.
Figure 36:
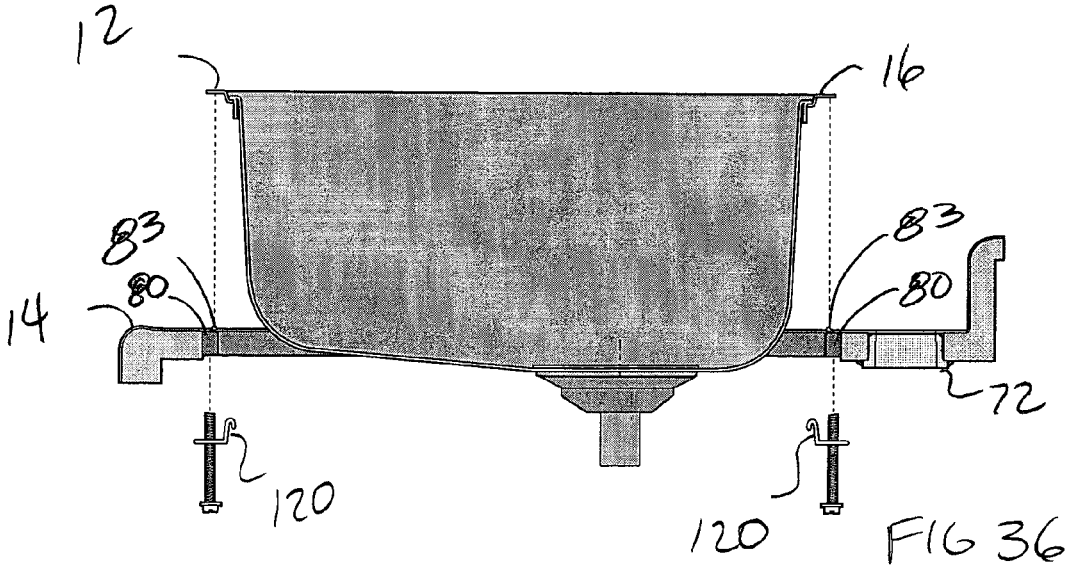

As shown in FIGS. 35 and 36, the sink 12 can then be installed so that the flange 16 of the sink 12 sits in the rabbet 83 cut into the sink ring 80. Prior to installing the sink the epoxy is preferably cleaned using the methyl hydrate 68. Preferably in order to seal the joint between the flange 16 of the sink 12 and the sink ring 80, there is first applied to the epoxy, the sealant 66 from the kit 30.

As suggested above, the epoxy is tinted with a grey colour to make it more clearly visible during these machining operations. Otherwise the epoxy would be clear and it would be more difficult to visualize the cuts being made. Because the epoxy has been coated grey, it is suggested that a grey coloured sealant also be used.

Figure 2:
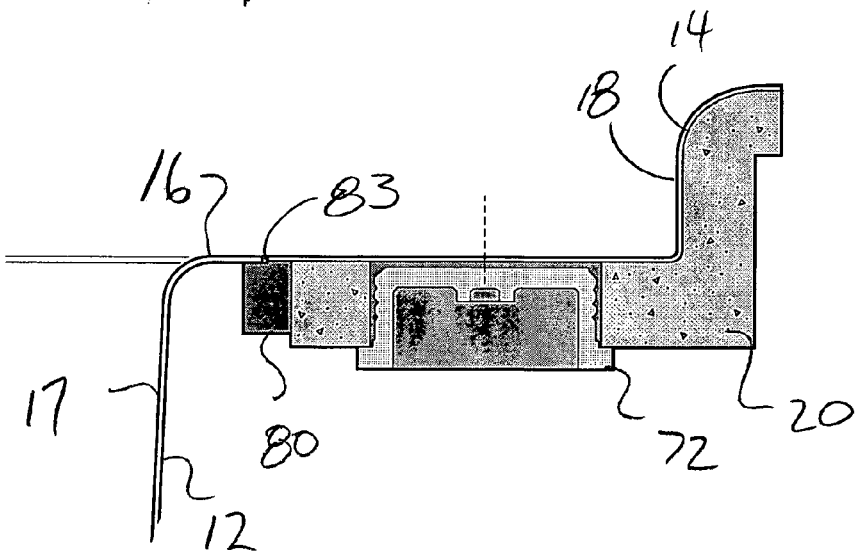
FIG. 2 is a view similar to FIG. 1 but at expanded scale of a portion of the installation illustrated in FIG. 1.

The sink 12 is provided with mounting clips 120 spaced about the flange 16 of the sink 12. Those mounting clips 120, as shown in FIGS. 1 and 2, permanently mount the sink 12 to the countertop 14. As the mounting clips are tightened, some sealant will be squeezed out. The excess sealant can be cleaned up with wipers 69. A useful wiper is available from Bostik™ which is a citrus based cleaner which is water soluable.

Figure 33:
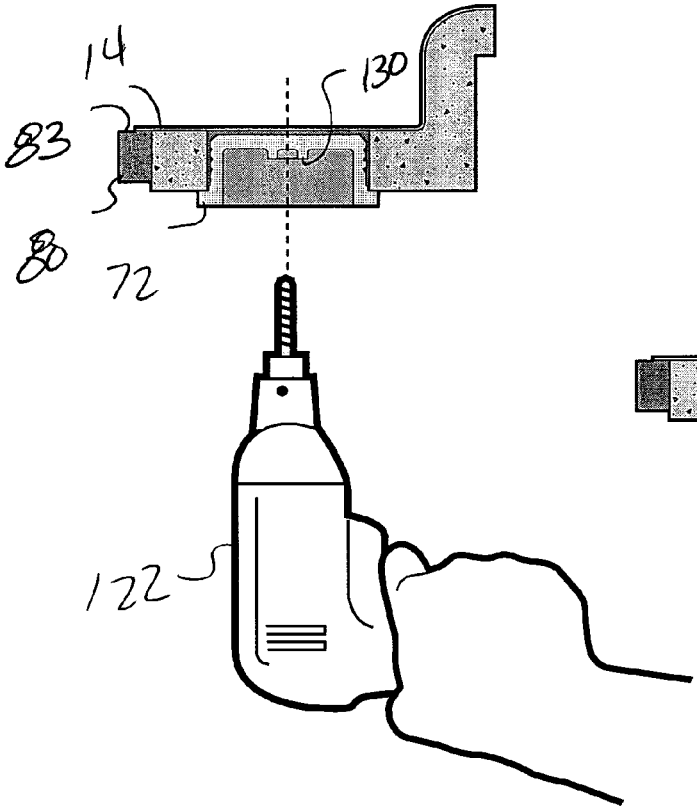
FIGS. 33 and 34 illustrate additional steps in accordance with the second aspect of the invention.
Figure 34:
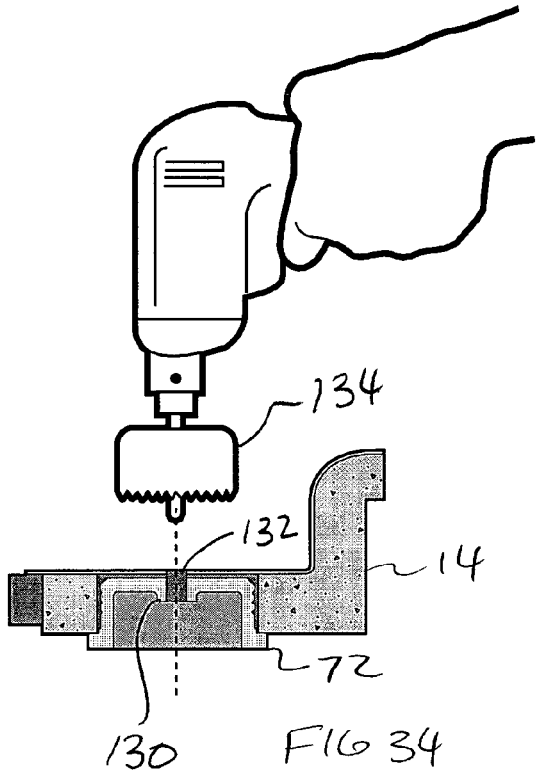

In accordance with the second aspect of the invention, the faucet can then be mounted. To do so, the user determines which ones of the epoxy filled faucet channels 111, the particular installation requires. For each of the filled faucet channels 111 that are desired to form the basis of a faucet hole 112, the following procedure is adopted. As shown in FIG. 33, a drill 122 is passed from the bottom surface of the counter upwardly through a pilot guide 130 cast in the faucet hole plug 72. The pilot guide is shown as 130. Passing the drill 122 through the faucet hole plug 72 aligned by the pilot guide 130 then creates a pilot hole 132 through the base of the faucet hole plug 72 and through the laminate as well as the intervening hardened epoxy. Then, by using the pilot hole 132, a hole saw 134 is used to cut a hole first in the laminate, secondly the epoxy and thirdly through the bottom wall of the faucet hole plug 72. The generally cylindrical wall of the faucet hole plug 72 can remain permanently mounted in the counter as shown in FIG. 34. This operation then creates a faucet hole 112 where desired.

The faucet can then be mounted in accordance with the faucet maker's mounting instructions. One of the major advantages of using the faucet hole plug 72, as described herein, is that the amount of epoxy required is diminished but also, and perhaps as importantly, it has been noted that epoxies of this type do shrink somewhat on hardening. At the time the plurality of faucet holes are being created it may not be known to the fabricator what faucet is to be installed. If a faucet is installed which is smaller than the horizontal extent of the plurality of faucet holes (5 shown in the example), then the laminate over one or more unusual faucet channels will be visible. If the hardenable plastic shrinks on hardening, there may be some "dishing" of the laminate over the faucet channel. Therefore it has been found that to create a more visually acceptable countertop, the faucet hole plug 72 is preferably used. The faucet hole plug 72 by displacing much of the hardenable plastic reduces shrinkage to maintain an after hardening acceptable appearance.

Referring now to FIG. 3, the kit 30 conveniently includes most of the parts required to carry out the method described above. It is believed that those involved in preparing countertops for installation of sinks and faucets will have available to them suitable material for use as bridging or fences. While reference has been made to use of a drill and router, any standard available drill or router may be used to carry out the invention. While those possessing routers may conveniently already have a number of bushings and cutters, in order to ensure convenient correlation of the templates referred to herein, it is preferable to supply a guide bushing 46. Most conveniently, the guide bushing is a one inch router guide bushing of the kind conveniently available.

The first cutter 48 used to cut the sink channel 100 and the faucet channel 110 in the wood based body 20 of the countertop 14 can conveniently be a one half inch straight flute cutter. Using this cutter, the chisel 54, supplied, is also a one half inch chisel. The cutter 52 used to cut the rabbet 83 in the hardened epoxy is conveniently supplied as part of the kit. The second cutter 50 used to trim the wood based support body 20 of the countertop 14 after use of the jig saw 92 is a conventional ⅝ inch straight flute cutter. This cutter may also be used with the router guide bushing 46 as shown.

The templates and cores may conveniently be made from any suitable material which have the necessary dimensional stability and the ability to guide the router. Typically a ½ inch thick plastic material may be used for cores and templates referred to herein.

The templates are custom sized to meet each particular sink. Thus, while sinks of different extents may be used, then the kit is varied so that the templates correlate to the sink.

While the invention has been described above in connection with manually guided tools and templates, the invention may be carried out using machine guided tools. Thus, the kit which is useful for hand guided installations would not be required for automated cutters such as C.N.C. machines. Such a programmable machine may be programmed with the appropriate dimensional data for a plumbing appliance, whether sink, faucet, accessory or any combination so that a countertop may be prepared for installation of a specific dimensionally related sink, faucet or accessory.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

The invention claimed is:

1. A method of mounting a sink in a countertop, the countertop having an upper laminate surface layer and an underlying wood based support body, comprising, providing a sink, said sink having a peripheral mounting flange, forming a sink channel in said support body, adding a hardenable plastic to said channel, permitting said plastic to harden, cutting said hardened plastic and said laminate surface to form a sink opening adapted to receive said flange, and mounting said sink in said sink opening.

2. The method of claim 1 further comprising forming a rabbet in said hardened plastic.

3. The method claim 2 further comprising removing said laminate surface layer adjacent said rabbet.

4. The method of claim 3 wherein the combined depth resulting from removal of said laminate and the depth of said rabbet is related to the thickness of said flange of said sink such that the top surface of said flange will be substantially flush with the remaining laminate surface layer.

5. The method of claim 4 wherein said sink is mounted to said hardened plastic over a layer of sealant to inhibit water flow between said flange and said hardened plastic.

6. The method of claim 5 wherein said sink opening comprises a perimeter bounded only by said hardened plastic.

7. The method of claim 6 further comprising using a first sink template having an inner perimeter for guiding a first cutting tool to be used for forming said sink channel in said support body.

8. The method of claim 7 further comprising using a sink core corresponding to said first sink template for supporting said first cutting tool.

9. The method of claim 8 further comprising providing an adjustment step in a peripheral edge of said sink core for accommodating test cuts of said first cutting tool within the inner perimeter of said first sink template.

10. The method of claim 2 further comprising using a first sink template having an inner perimeter for guiding a first cutting tool to be used for forming said sink channel in said support body and using a second sink template for guiding a cutting tool to be used for forming said rabbet.

11. A kit of parts for carrying out the method of claim 1 comprising, a sink, said sink having a peripheral mounting flange, a first cutting tool for forming said sink channel, a second cutting tool for forming said rabbet, and, a hardenable plastic.

12. The kit of claim 11 further comprising a first sink template for guiding said first cutting tool.

13. The kit of claim 12 further comprising a second sink template for guiding said second cutting tool.

14. The kit of claim 13 further comprising a faucet template for guiding a cutting tool for cutting at least one faucet channel in said countertop.

15. The kit of claim 14 further comprising a plurality of faucet channel plugs.

16. A method of preparing a countertop for installation of a faucet, the countertop having an upper laminate surface layer and an underlying wood based support body comprising, providing a plurality of faucet channel plugs, forming a plurality of faucet channels in said support body, adding a hardenable plastic to said faucet channels, inserting into said faucet channels, a respective one of faucet channel plugs before said plastic hardens, thereby displacing said hardenable plastic to flow around said faucet channel plug and thereafter permitting said plastic to harden, so that said upper laminate surface layer and said plurality of faucet channel plugs may be cut to form a plurality of faucet openings for receiving said faucet.

17. The method of claim 16 wherein the faucet channel has a bottom and said bottom is comprised of said laminate surface layer.

18. The method of claim 17 wherein said faucet channel plug comprises a pilot guide for drilling a pilot hole in said laminate.

19. The method of claim 18 further comprising boring a pilot hole using pilot guide, and cutting a faucet hole using said pilot hole.

20. The method of claim 16 further comprising, using at least one faucet template for guiding a first cutting tool to be used for forming said faucet channels.

* * * * *